US010696528B2

(12) United States Patent
Brouillac

(10) Patent No.: US 10,696,528 B2
(45) Date of Patent: Jun. 30, 2020

(54) DEVICE FOR EJECTING A CORK FROM A CORKSCREW AND CORKSCREW PROVIDED WITH SUCH AN EJECTION DEVICE

(71) Applicant: PSP, Quingey (FR)

(72) Inventor: Nicolas Brouillac, Saint Vit (FR)

(73) Assignee: PSP, Quingey (FR)

( * ) Notice: Subject to any disclaimer, the term of this patent is extended or adjusted under 35 U.S.C. 154(b) by 22 days.

(21) Appl. No.: 15/776,869

(22) PCT Filed: Oct. 27, 2016

(86) PCT No.: PCT/FR2016/052803

§ 371 (c)(1),
(2) Date: May 17, 2018

(87) PCT Pub. No.: WO2017/085370

PCT Pub. Date: May 26, 2017

(65) Prior Publication Data

US 2018/0327241 A1 Nov. 15, 2018

(30) Foreign Application Priority Data

Nov. 19, 2015 (FR) ..... 15 61148

(51) Int. Cl.
*B67B 7/04* (2006.01)

(52) U.S. Cl.
CPC ..... *B67B 7/0441* (2013.01); *B67B 7/04* (2013.01); *B67B 7/0405* (2013.01)

(58) Field of Classification Search
CPC ... B67B 7/0441; B67B 7/0447; B67B 7/0417; B67B 7/04; B67B 7/0405; B67B 7/00; B67B 2007/047; B67B 7/10
USPC ..... 81/3.29, 3.08, 3.09, 3.2, 3.45
See application file for complete search history.

(56) References Cited

U.S. PATENT DOCUMENTS 4,637,283 A 1/1987 Bertram
5,012,703 A * 5/1991 Reinbacher ..... B67B 7/08 81/3.2
5,079,975 A * 1/1992 Spencer, Jr. ..... B67B 7/0405 81/3.2

(Continued)

FOREIGN PATENT DOCUMENTS

CN 200720038391 * 6/2007 ..... B67B 7/04
CN 101081684 A 12/2007

(Continued)

*Primary Examiner* — Orlando E Aviles
*Assistant Examiner* — Robert F Neibaur
(74) *Attorney, Agent, or Firm* — Craft Chu PLLC; Andrew W. Chu

(57) ABSTRACT

The device for ejecting a cork from a corkscrew includes a body in which a spiral is received. There is a tubular cradle housed in a housing to accommodate the spiral and a cork screwed in the spiral. The cradle is formed by a stationary sleeve secured to the body and a sliding sleeve, translatable relative to the stationary sleeve, between a position in which it is completely nested in the stationary sleeve and a position in which it is at least partially removed from the stationary sleeve. Each sleeve has an upper end and a lower end, and the sliding sleeve has a mechanism to exert a force on the cork oriented toward the lower end of the stationary sleeve.

13 Claims, 3 Drawing Sheets

(56) References Cited

U.S. PATENT DOCUMENTS

| | | | | |
|---|---|---|---|---|
| 7,069,825 | B2 * | 7/2006 | Cheung | B67B 7/0441 81/3.09 |
| 7,231,850 | B2 * | 6/2007 | Wang | B67B 7/08 81/3.2 |
| 10,196,251 | B2 * | 2/2019 | Kalogroulis | B67B 7/0441 |

FOREIGN PATENT DOCUMENTS

| | | | | |
|---|---|---|---|---|
| CN | 200720038391 | * | 5/2008 | B67B 7/04 |
| CN | 201214621 | Y | 4/2009 | |
| FR | 2557087 | A1 | 6/1985 | |
| GB | 191326676 | A | 1/1914 | |

* cited by examiner

DEVICE FOR EJECTING A CORK FROM A CORKSCREW AND CORKSCREW PROVIDED WITH SUCH AN EJECTION DEVICE

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to a device for ejecting a cork from a corkscrew of the type including a body traversed by a tubular passage defining a housing in which a spiral is received that is able to be rotated around the longitudinal axis of said body using a gripping element connected to one of its ends and extending outside said body.

The invention also relates to a corkscrew, of the type including a body traversed by a tubular passage defining a housing in which a spiral is received, equipped with such a device for ejecting a cork.

2. Description of Related Art Including Information Disclosed Under 37 CFR 1.97 and 37 CFR 1.98

Traditionally, to uncork a bottle using such a corkscrew, a user first fits the body of the latter on the neck of the bottle. He next screws the spiral into the cork closing the bottle, then exerts a rotational force on the latter translating the cork through the effect of a helical spiral, making it possible to remove it from the bottle and cause it to abut at the bottom of the housing delimited by the body of the corkscrew. The user next removes the body of the corkscrew from the neck of the bottle, and unscrews the spiral. Ideally, the freed cork should then fall from the body of the corkscrew by gravity to be able to be recovered, for example in the user's hand placed below the corkscrew, and next allow the corkscrew to be used again.

In practice, it is frequently observed that many corks, in particular due to their slight expansion once removed from a bottle, remain jammed in the housing inwardly delimited by the body of the corkscrew and the dimensions of which are generally adjusted to those of the cork. When this occurs, the user obviously has no other solution than to insert his fingers into the body of the corkscrew in order to grasp the cork, and manually free it from the housing, or to push the cork by unscrewing half of the spiral from the corkscrew. Such an approach is not only tedious, but also has the unacceptable drawback of causing slight injuries in some cases to the user's fingers, compressed in the small volume of the body of the corkscrew to extricate the cork therefrom. Lastly, a cork, in particular when it is made from a brittle material such as cork itself, may be damaged by the somewhat brutal handling that it inevitably experiences during its forced removal. This may then prevent it from being reused later to reclose a partially consumed bottle, and force the user to obtain a spare cork, which may in some cases be of lesser quality.

BRIEF SUMMARY OF THE INVENTION

The present invention aims to offset these drawbacks proposing a solution allowing a user to remove, easily and successfully with each attempt, a cork held in the body of a corkscrew without having to insert his fingers therein, or having to push the cork with the corkscrew, therefore made safer, and while preserving the structural integrity of the cork in question.

To that end, the present invention relates to a device for ejecting a cork from a corkscrew of the type indicated in the preamble, characterized in that it includes a tubular cradle able to be housed in the housing of a corkscrew and to accommodate said spiral and a cork screwed on the spiral, said cradle being formed by a stationary sleeve intended to be secured to said body of the corkscrew and a sliding sleeve, translatable relative to the stationary sleeve, between a position in which it is completely nested in the stationary sleeve and a position in which it is at least partially removed from said stationary sleeve, said stationary and sliding sleeves having an upper end and a lower end considered in a vertical position of the ejection device, and said sliding sleeve including means able to exert, on a cork retained in said corkscrew, a force oriented toward the lower end of the stationary sleeve, when it is brought toward its position in which it is at least partially removed from said stationary sleeve.

The invention also relates to a corkscrew including a hollow body arranging a housing in which a spiral is received able to be rotated around the longitudinal axis of said body using a gripping element connected to one of its ends and extending outside said body, said housing being able to accommodate a cork screwed on the spiral and having, near the free end of the spiral, at least a portion with a circular section able to be fitted on the neck of a bottle, characterized in that it includes a device for ejecting a cork as defined above.

BRIEF DESCRIPTION OF THE SEVERAL VIEWS OF THE DRAWINGS

Other features and advantages of the invention will emerge from the following detailed description relative to one embodiment of the ejection device given solely for information and non-limitingly.

The understanding of this description will be facilitated in reference to the attached drawings.

DETAILED DESCRIPTION OF THE INVENTION

Figures 1, 2:
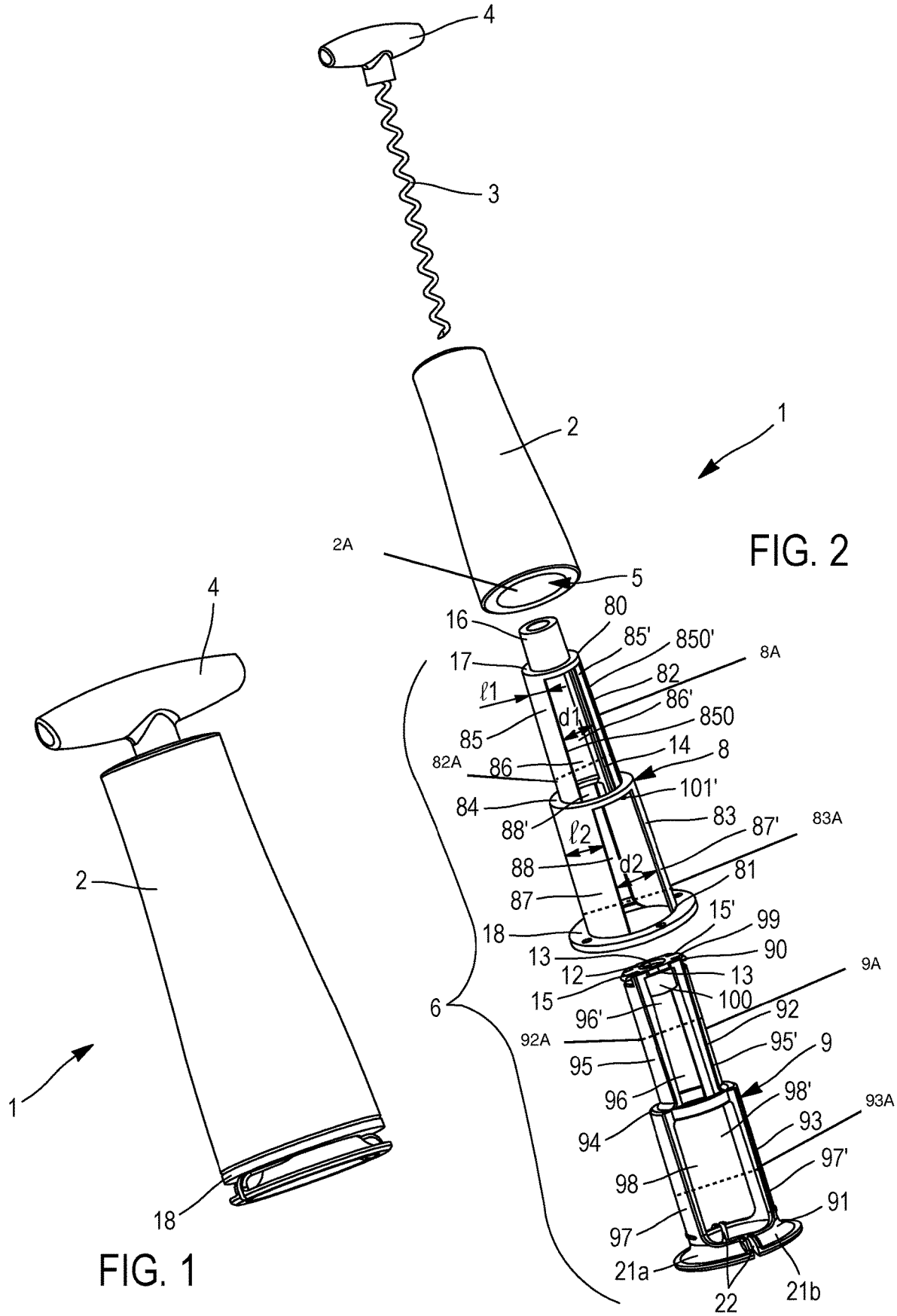
FIG. 1 shows a perspective view of a corkscrew according to the invention.
FIG. 2 shows a perspective view of all of the component parts of the corkscrew of FIG. 1.
Figure 3:
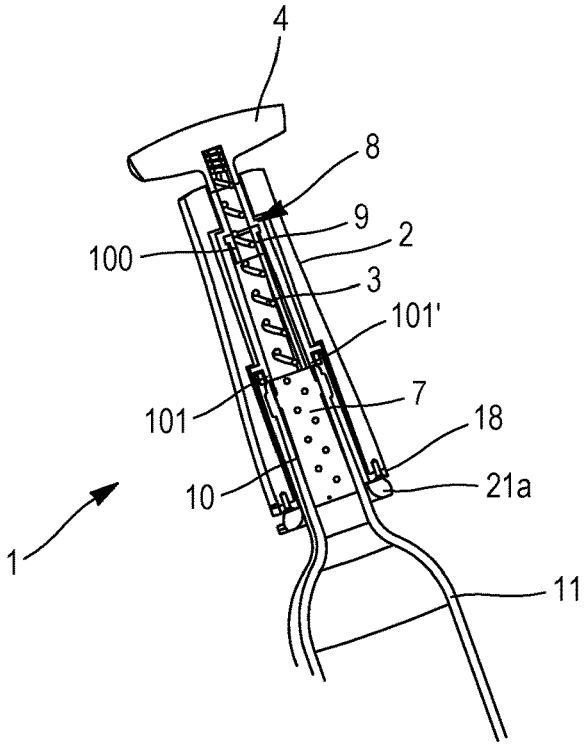
FIGS. 3 to 8 show sectional views of the corkscrew of FIG. 1 during different steps of its use to uncork a bottle.
Figure 4:
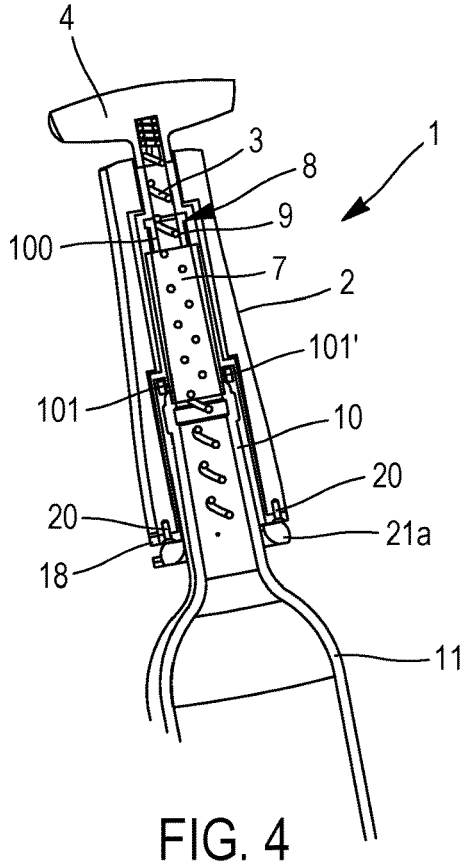

In the alternative embodiment illustrated in the figures, the corkscrew 1 according to the invention includes a generally tubular body 2 with a tubular passage 2A, the outer wall of which is solid, and which can be made from a material such as in particular wood, metal, plastic, a composite material, or any other equivalent material that is both solid and aesthetically pleasing. Traditionally, the body 2 inwardly delimits a housing 5 able to house a spiral 3 intended to be rotated around the longitudinal axis of the body 2 by a user manipulating a gripping element, such as a handle 4 emerging from the body 2 and connected to one end of the spiral 3.

According to the invention, the corkscrew 1 is also equipped with a device for ejecting a cork 7 remaining housed in the housing 5 after it has been removed from a bottle 11. The ejection device includes a tubular cradle 6. As shown in FIGS. 3 to 8, the housing 5 and the cradle 6 have a complementary shape allowing them to be fitted. The cradle 6 is also configured so as to be able to accommodate the spiral 3 and a cork 7 screwed in the spiral 3. The cradle 6 can for example be made from a material such as a plastic, composite material, ceramic material, metal or any other equivalent material.

Figure 5:
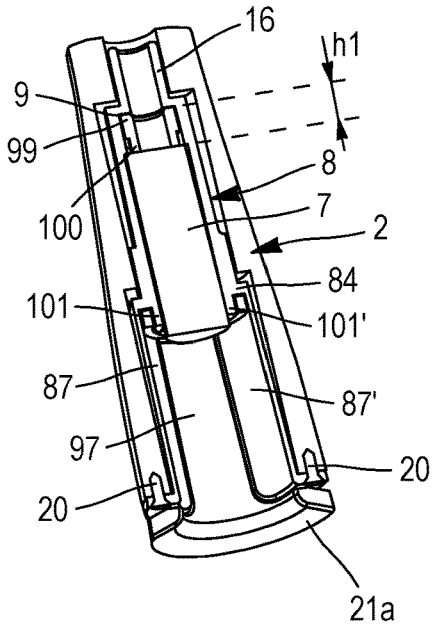
Figure 6:
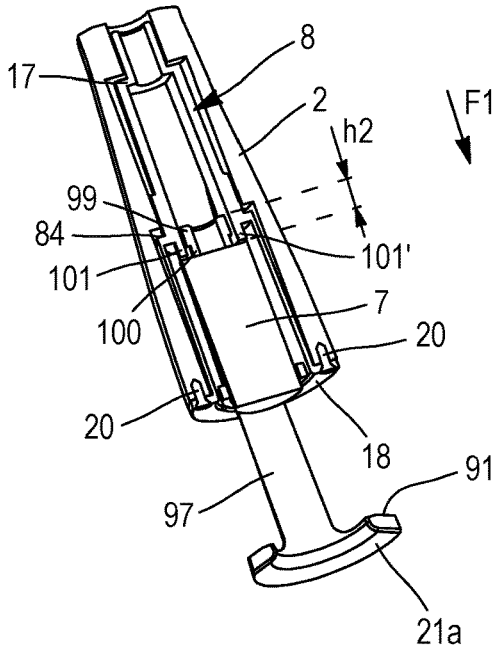
Figure 7:
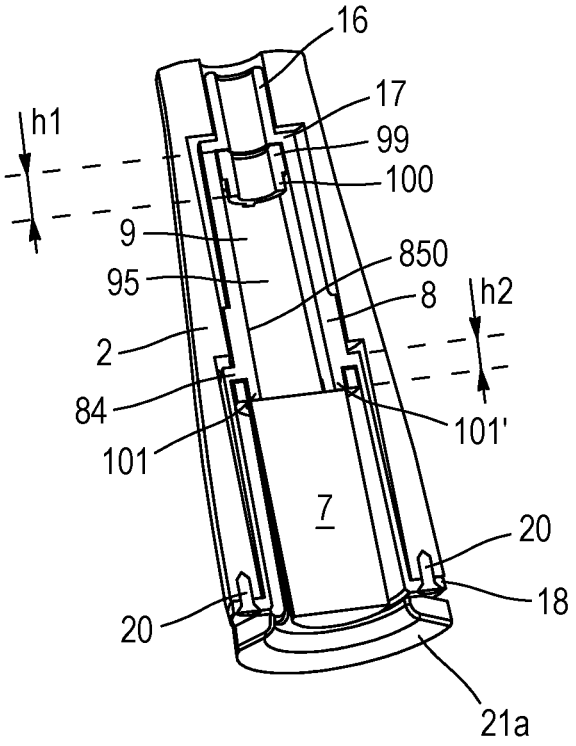
Figure 8:
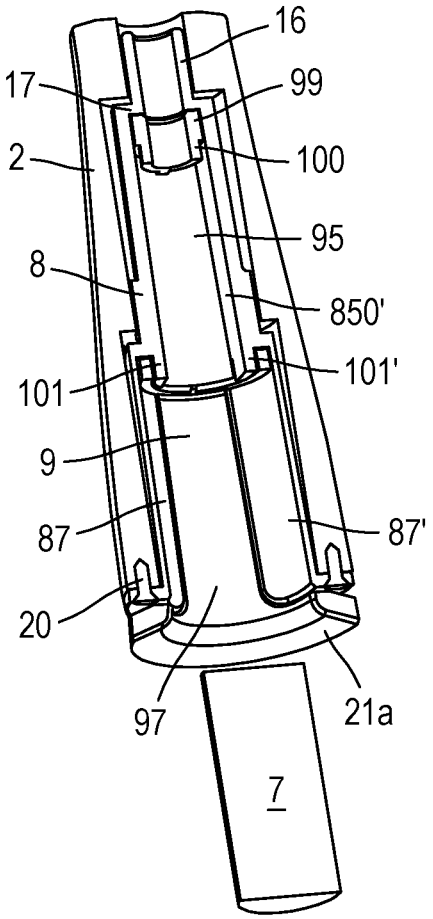

In the illustrated alternative embodiment, the cradle 6 is formed by a stationary sleeve 8 intended to be secured to the body 2 of the corkscrew 1 and a sliding sleeve 9, translatable relative to the stationary sleeve 8, between a position in which it is completely nested and housed in the stationary sleeve 8 (cf. for example FIG. 5) and a position in which it is at least partially removed from the stationary sleeve 8 (cf. FIG. 6).

The stationary 8 and sliding 9 sleeves (stationary sleeve 8, sliding sleeve 9) have an upper end 80, 90 (stationary sleeve upper end 80, sliding sleeve upper end 90) and a lower end 81, 91 (stationary sleeve lower end 81, sliding sleeve lower end 91) considering a vertical position of the cradle 6. They each have a first segment 82, 92, (first stationary sleeve section 82, first sliding sleeve section 92) the section of which is provided able to accommodate, in a tight manner, a cork 7 screwed on the spiral 3 and a second segment 83, 93, (second stationary sleeve section 83, second sliding sleeve section 93) with a section larger (second stationary sleeve section diameter 83A larger than first stationary sleeve section diameter 82A, second sliding sleeve section diameter 93A larger than first sliding sleeve section diameter 92A) than that of the first segment 82, 92 able to be nested on the neck 10 of a container closed by the cork 7, such as a bottle 11. Each of the stationary 8 and sliding 9 sleeves thus has a shoulder 84, 94 formed between its first segment 82, 92 and its second segment 83, 93

In the illustrated alternative embodiment, the peripheral wall (stationary sleeve peripheral wall 8A) of the stationary sleeve 8 includes two strips of material 85, 85', the outer faces of which are curved, while the inner faces 850, 850' are planar. These two strips of material 85, 85' are symmetrical relative to the axis of the stationary sleeve 8 and extend over its first segment 82 between its upper end 80 and its shoulder 84. Their inner faces 850, 850' are spaced apart by a distance d1 allowing the gripping of a cork 7. Furthermore, the strips of material 85, 85' extend below the shoulder 84 and thus define two fins 101, 101' with tight h2 extending at the upper end of the second segment 83 of the stationary sleeve 8. Furthermore, the strips of material 85, 85' delimit two longitudinal slits 86, 86' also extending between the upper end 80 and the shoulder 84 of the first segment 82.

The peripheral wall of the stationary sleeve 8 further includes two strips of material 87, 87' that are symmetrical relative to the axis of the stationary sleeve 8 and extending over its second segment 83 between its shoulder 84 and its lower end 81, while delimiting two longitudinal slits 88, 88' (cf. FIG. 2). The material strips 87, 87' of the second segment 83 of the stationary sleeve 8 have curved inner faces, spaced apart by a diameter d2 and having a width 12 greater than the width 11 of the strips of material 85, 85' of the first segment 82, and chosen so as to impart an identical width to all of the longitudinal slits 86, 86', 88, 88' of the stationary sleeve 8.

The sliding sleeve 9 has a peripheral wall (sliding sleeve peripheral wall 9A) complementary to that of the stationary sleeve 8. Indeed, it includes, on each of its first and second segments 92, 93, two strips of material 95, 95', 97, 97' respectively extending between its upper end 90 and the shoulder 94, and between the latter and its lower end 91. These strips of material 95, 95', 97, 97' are complementary to the longitudinal slits 86, 86', 88, 88' of the stationary sleeve 8 and thus delimit, on the sliding sleeve 9, longitudinal slits 96, 96', 98, 98' complementary to the strips of material 85, 85', 87, 87' of the stationary sleeve 8.

It should also be noted that the strips of material 85, 85', 87, 87', 95, 95', 97, 97' include rectilinear longitudinal edges.

Owing to such a structure, the two stationary 8 and sliding 9 sleeves can be nested, their respective strips of material 85, 85', 87, 87', 95, 95', 97, 97' being inserted in their respective longitudinal slits 86, 86', 88, 88', 96, 96', 98, 98' and consequently being in contact with one another at their respective straight longitudinal edges. The latter define, as will be described in more detail below, first means for guiding the translation of the sliding sleeve 9 relative to the stationary sleeve 8. It should be noted that the sliding sleeve 9 is blocked in rotation relative to the stationary sleeve 8 owing to the contact between the respective longitudinal edges of the strips of material 85, 85', 87, 87', 95, 95', 97, 97' irrespective of its position relative to the stationary sleeve 8.

According to the invention, the upper end 90 of the sliding sleeve 9 is also closed by a membrane seal 99 having a central orifice 12 able to allow the spiral 3 to pass when the cradle 6 is nested in the body 2 of the corkscrew 1.

In reference to FIG. 2, the edge of the membrane seal 99 of the sliding sleeve 9 includes two opposite slots 13, centered in the extension of each of the longitudinal slits 96, 96'. They are provided able to cooperate, when the two sleeves 8, 9 are nested, with two opposite longitudinal ribs 14, centered on the planer inner face 850, 850' of each of the complementary strips 85, 85' of the peripheral wall of the first segment 82 of the stationary sleeve 8, intended to be received in said slit 96, 96'. The assembly formed by the two slots 13 of the sliding sleeve 9 and the two longitudinal ribs 14 of the stationary sleeve 8 defines second means for guiding the translation of the sliding sleeve 9 relative to the stationary sleeve 8.

It should be noted that the ribs 14 also make it possible to ensure rotational blocking of a cork 7, housed in the part of the corkscrew 1 formed by the first segments 82, 92 of the stationary 8 and sliding 9 sleeves, after it is removed from a bottle 11, during the unscrewing of the spiral 3. Of course, other means for blocking the rotation of the cork 7 can be considered, for example a pair of ribs formed on the inner face of each of the strips of material 95, 95' of the sliding sleeve 9, or any other equivalent means.

Furthermore, the membrane seal 99 also includes two opposite tabs 15, 15' extending in its plane, on its edge, in the extension of the two strips of material 95, 95' of the first segment 92 of the sliding sleeve 9. These two tabs 15, 15' bear on the shoulder 84 of the stationary sleeve 8 when the sliding sleeve 9 is brought toward its position in which it is at least partially removed from the stationary sleeve 8, so as to prevent it from being completely removed from the stationary sleeve 8. Furthermore, each of the tabs 15, 15' has two opposite side edges that extend abutting against the longitudinal edges of the strips of material 85, 85' of the stationary sleeve 8, which also prevents any rotation of the sliding sleeve 9 relative to the stationary sleeve 8. Lastly, the lower face of the membrane seal 99 is extended by a tubular stop 100, centered on its central orifice 12, and having a height h1 identical to the height h2 of the fins 101, 101'.

The stationary sleeve 8 further includes a third segment 16 extending in the extension of its first segment 82 and having an outer diameter smaller than the outer diameter of the first segment 82. Thus, the stationary sleeve 8 includes a second shoulder 17 extending between its first segment 82 and its third segment 16.

Furthermore, the lower end 81 of the stationary sleeve 8 includes a flange 18 on which a plurality of holes 19 extend, regularly distributed and allowing the fastening of the stationary sleeve 8 to the body 2 of the corkscrew 1, for example using screws 20 inserted into the holes 19 and screwed in the body 2. Of course, other equivalent fastening means may be considered.

The lower end 91 of the sliding sleeve 9 is extended by a flange 21 extending in front of the flange 18 of the stationary sleeve 8 when the two sleeves are nested. This flange 21 provides the gripping function allowing a user to handle the ejection device according to the invention more easily. In the illustrated alternative embodiment, the gripping flange 21 includes two transverse slits 22 dividing it into two half-flanges 21*a*, 21 extending in the extension of the strips of material 97, 97' of the second segment 93 of the sliding sleeve 9. This makes it possible to bring these two strips of material 97, 97' closer together to facilitate the sliding of the sliding sleeve 9 relative to the stationary sleeve 8, as will be explained below.

In practice, and in reference to FIGS. 3 to 8, during the use of the corkscrew 1 according to the invention, equipped with the ejection device described above, to uncork a bottle 11, the user first makes sure that the sliding sleeve 9 is completely nested in the stationary sleeve 8 and that it is consequently retracted in the latter. He next nests the corkscrew 1 on the neck 10 of the bottle 11, closed by the cork 7. The assembly formed by the respective second segments 83, 93 of the stationary 8 and sliding 9 sleeves is then placed around the neck 10 (cf. FIG. 3). The spiral 3 is next screwed in the stopper 7 and a pulling force exerted on the latter makes it possible to bring it gradually into the assembly formed by the respective first segments 82, 92 of the stationary 8 and sliding 9 sleeves until it is stopped by the annular stop 100 of the membrane seal 99 of the sliding sleeve 9 (cf. FIG. 4). The distance d1 comprised between the planar inner faces 850, 850' of the strips of material 85, 85' of the first segment 82 of the stationary sleeve being chosen so as to obtain a tight adjustment of the cork 7 received in the cradle 6, said cork 7 remains in the compressed state in which it was found while it was housed in the bottle 11. The latter now being uncorked, the user removes the corkscrew 1 from the neck 10, the cork 7 remaining screwed on the spiral 3 and blocked in the body 2 of the corkscrew 1.

In order to allow the corkscrew 1 to be used again, and consequently to free the cork 7 blocked in the cradle 6, the user unscrews the spiral 3 (cf. FIG. 5). He next grasps the two half-flanges 21*a*, 21*b* bordering the lower end 91 of the sliding sleeve 9. This results in causing the strips of material 97, 97' of the sliding sleeve 9 to tighten, and makes the sliding of the latter part easier relative to the stationary sleeve 8. The sliding sleeve 9, guided in translation by the first and second translational guiding means described above, is gradually removed from the body 2 of the corkscrew 1. During its movement, the sliding sleeve 9 takes the cork 7 with it, on which the tubular stop 100 of the membrane seal 99 exerts a force F1 oriented toward the lower end 80 of the stationary sleeve 8. When the tabs 15 of the membrane seal 99 abut on the shoulder 84 of the stationary sleeve 8, the first segment 92 of the sliding sleeve 9, still containing the cork 7, is housed inside the second segment 83 of the stationary sleeve 8 (cf. FIG. 6). The cork 7 is then no longer constrained between the strips of material 85, 85', 95, 95' of the stationary 8 and sliding 9 sleeves, but can expand at least partially between the strips of material 95, 95' of the sliding sleeve 9, and the strips of material 87, 87' of the stationary sleeve 8. Owing to the presence of the tubular stop 100 having a height h1 equivalent to that h2 of the fins 101, 101', the upper face of the cork 7 is located just below the lower end of said fins 101, 101'. Then, due to its at least partial expansion, the edge of the upper face of the cork 7 abuts against the lower end of the fins 101, 101' of the stationary sleeve 8. Consequently, when the user pushes the sliding sleeve 9 back so as to re-nest it in the stationary sleeve 8, the cork 7 is no longer taken with it, but remains in the assembly formed by the respective second segments 83, 93 of the stationary 8 and sliding 8 sleeves, retained by its fins 101, 101' (cf. FIG. 7). The inner diameter d2 of this assembly being larger than that of the cork 7, the latter now falls by gravity and can be recovered easily by the user (cf. FIG. 8).

It should be noted that the ejection device according to the invention can be designed as a universal module suitable for adapting to a large number of corkscrews having different shapes and characteristics.

I claim:

1. A tubular cradle for ejecting a cork from a corkscrew having a body forming a housing and tubular passage and a spiral, the tubular cradle comprising:

a stationary sleeve having a stationary sleeve upper end and a stationary sleeve lower end opposite said stationary sleeve upper end, wherein said stationary sleeve is comprised of a first stationary sleeve section having a first stationary sleeve section diameter at said stationary sleeve upper end, a second stationary sleeve section having a second stationary sleeve section diameter at said stationary sleeve lower end, and a stationary sleeve shoulder between said first stationary sleeve section and said second stationary sleeve section, and wherein said second stationary sleeve section diameter is greater than said first stationary sleeve section diameter, a sliding sleeve having a sliding sleeve upper end and a sliding sleeve lower end opposite said sliding sleeve upper end, wherein said sliding sleeve is comprised of a first sliding sleeve section having a first sliding sleeve section diameter at said sliding sleeve upper end, a second sliding sleeve section having a second sliding sleeve section diameter at said sliding sleeve lower end, and a sliding sleeve shoulder between said first sliding sleeve section and said second sliding sleeve section, and wherein said second sliding sleeve section diameter is greater than said first sliding sleeve section diameter;

and a means to exert force on the cork positioned at said sliding sleeve upper end, wherein said sliding sleeve has a nested position within said stationary sleeve, said first sliding sleeve section being housed in said first stationary sleeve section, said second sliding sleeve section being housed in said second stationary sleeve section, wherein said sliding sleeve has a translated position partially within said stationary sleeve, said first sliding sleeve section being housed in said second stationary sleeve section, said second sliding sleeve section extending outward from said a second stationary sleeve section, and wherein said sliding sleeve is moveable from said nested position to said translated position and back to said nest position so as to eject a cork from said corkscrew; and a membrane seal having a central orifice and being positioned over said sliding sleeve upper end, wherein the membrane seal further comprises an annular stop having an annular stop height centered on said center orifice, said annular stop extending downward from said sliding sleeve upper end so as to form said means to exert force on the cork.

2. The tubular cradle, according to claim 1, wherein said stationary sleeve has a stationary sleeve peripheral wall being comprised of means for blocking rotation of said sliding sleeve relative to said stationary sleeve, and wherein said sliding sleeve has a sliding sleeve peripheral wall being comprised of means for blocking rotation of said stationary sleeve relative to said sliding sleeve.

3. The tubular cradle, according to claim 2, wherein said first stationary sleeve section is comprised of a plurality of first stationary sleeve strips of material with longitudinal edges and a plurality of first stationary sleeve longitudinal slits alternating with said first stationary sleeve strips of material, wherein said second stationary sleeve section is comprised of a plurality of second stationary sleeve strips of material with longitudinal edges and a plurality of second stationary sleeve longitudinal slits alternating with said second stationary sleeve strips of material, wherein said means for blocking rotation of said sliding sleeve 9 relative to said stationary sleeve is comprised of said first stationary sleeve strips of material with longitudinal edges and said second stationary sleeve strips of material with longitudinal edges, wherein said first sliding sleeve section is comprised of a plurality of first sliding sleeve strips of material with longitudinal edges and a plurality of first sliding sleeve longitudinal slits alternating with said first sliding sleeve strips of material, wherein said second sliding sleeve section is comprised of a plurality of second sliding sleeve strips of material with longitudinal edges and a plurality of second sliding sleeve longitudinal slits alternating with said second sliding sleeve strips of material, and wherein said means for blocking rotation of said stationary sleeve relative to said sliding sleeve is comprised of said first sliding sleeve strips of material with longitudinal edges and said second sliding sleeve strips of material with longitudinal edges.

4. The tubular cradle, according to claim 3, wherein said plurality of first stationary sleeve strips of material are slidably received in said plurality of first sliding sleeve longitudinal slits, wherein said plurality of first sliding sleeve strips of material are slidably received in said plurality of first stationary sleeve longitudinal slits, wherein said plurality of second stationary sleeve strips of material are slidably received in said plurality of second sliding sleeve longitudinal slits, and wherein said plurality of second sliding sleeve strips of material are slidably received in said plurality of second stationary sleeve longitudinal slits.

5. The tubular cradle, according to claim 4, wherein each first stationary sleeve strip of material has a respective inner face and respective rib, each respective rib extending downward past said membrane seal, wherein said membrane seal has corresponding longitudinal slots aligned with said plurality of first sliding sleeve longitudinal slits, and wherein each respective rib is in sliding engagement with respective longitudinal slot and a respective first sliding sleeve longitudinal slit.

6. The tubular cradle, according to claim 4, the membrane seal further comprising: a tab wherein said tab extends outward from said membrane seal and said sliding sleeve peripheral wall, and wherein said tab is in abutment against said stationary sleeve shoulder with said sliding sleeve in said translated position.

7. The tubular cradle, according to claim 1, wherein said sliding sleeve is further comprised of a gripping means at said sliding sleeve lower end.

8. The tubular cradle, according to claim 7, wherein said gripping means is comprised of a gripping flange at said sliding sleeve lower end.

9. The tubular cradle, according to claim 4, wherein said sliding sleeve is further comprised of a gripping means at said sliding sleeve lower end, wherein said gripping means is comprised of a gripping flange at said sliding sleeve lower end, and wherein said gripping flange is comprised of a transverse slit aligned with at least one of said plurality of second sliding sleeve longitudinal slits.

10. The tubular cradle, according to claim 1, wherein said stationary sleeve is further comprised of a flange at said stationary sleeve lower end so as to attach to said corkscrew.

11. The tubular cradle, according to claim 3, wherein each first stationary sleeve strip of material is comprised of a fin with a fin height, each fin extending downward from said stationary sleeve shoulder, and wherein said annular stop height is equal to said fin height.

12. A corkscrew assembly to accommodate a cork, comprising:

a body forming a housing and tubular passage;

a spiral mounted within said tubular passage; and a tubular cradle, according to claim 1, said spiral extending through said first stationary sleeve section and said first sliding sleeve section in said nested position.

13. The corkscrew assembly, according to claim 12, wherein said tubular cradle is fixedly attached within said housing, said tubular cradle having a shape complementary to said housing.

* * * * *